US006945260B1

(12) United States Patent
Stocchi et al.

(10) Patent No.: US 6,945,260 B1
(45) Date of Patent: Sep. 20, 2005

(54) MACHINE FOR TREATING OBJECTS

(75) Inventors: Gabriele Stocchi, Le Havre Cedex (FR); Gerard Doudement, Le Havre Cedex (FR)

(73) Assignee: Sidel, LeHavre Cedex (FR)

( * ) Notice: Subject to any disclaimer, the term of this patent is extended or adjusted under 35 U.S.C. 154(b) by 319 days.

(21) Appl. No.: 10/018,342

(22) PCT Filed: Jun. 28, 2000

(86) PCT No.: PCT/FR00/01799

§ 371 (c)(1),
(2), (4) Date: Jun. 14, 2002

(87) PCT Pub. No.: WO01/00340

PCT Pub. Date: Jan. 4, 2001

(30) Foreign Application Priority Data

Jun. 28, 1999 (FR) ..... 99 08209

(51) Int. Cl.[7] ..... B08B 3/02

(52) U.S. Cl. ..... 134/62; 134/166 R; 134/169 R; 134/78

(58) Field of Search ..... 134/62, 142, 166 R, 134/169 R, 80, 68, 72

(56) References Cited

U.S. PATENT DOCUMENTS 740,793 A * 10/1903 Barrick ..... 134/142
838,927 A * 12/1906 Wickham ..... 134/79
1,919,965 A * 7/1933 Taylor ..... 134/48
3,143,218 A * 8/1964 Umbricht et al. ..... 134/157
3,521,650 A * 7/1970 Braton et al.
4,074,654 A * 2/1978 Noguchi et al. ..... 118/73
4,083,055 A * 4/1978 Nishikawa et al. ..... 396/228
4,104,081 A * 8/1978 Totten ..... 134/23
4,161,086 A * 7/1979 Toedtli ..... 451/81
5,277,207 A * 1/1994 Perrier ..... 134/44
5,425,385 A * 6/1995 Kuta et al. ..... 134/48
5,598,859 A * 2/1997 Kronseder ..... 134/62
6,240,937 B1 * 6/2001 Salda ..... 134/62

FOREIGN PATENT DOCUMENTS

EP 0 319 504 A 6/1989
EP 0 477 341 A 4/1992
FR 2 444 001 A 7/1980
GB 2188309 * 9/1987

* cited by examiner

*Primary Examiner*—Frankie L. Stinson
(74) *Attorney, Agent, or Firm*—Sughrue Mion, PLLC

(57) ABSTRACT

A machine for treating objects having a series of stations (12) whereof each includes a system for gripping (16) a container (11) in a loading point of the path, wherein, between the loading and unloading points, the container (11) is displaced from an initial loading position to at least a treating position then to a final unloading position following the circular path. Each station is provided with a gripping unit (14) comprising at least two grip systems (16), and the gripping unit (14) is mobile relative to the station between at least two positions and, between the loading and unloading of an object, the path followed by the latter has a number of cycles of the circuit ranging between the number of grip systems (16) of each grip unit (14) and the next lower integer.

21 Claims, 4 Drawing Sheets

MACHINE FOR TREATING OBJECTS

The invention concerns machines for processing objects, in particular hollow bodies such as containers or preforms for containers.

More particularly, the invention concerns object processing machines in which a series of processing stations are movable along a path in a loop circuit, for example by being integral with a driven rotary turntable or a driven endless chain, and each of which stations has a gripping system intended to grasp an object at a loading point and to return it at a discharge point of the path. Between its point of loading and point of discharge, an object is moved relative to the station by the gripping system from an initial loading position to at least one processing position, then to a final discharge position. Moreover, the machine has devices for processing objects held by each station.

A machine of this type, intended for processing containers, is described, for example, in the document EP-A-0.477.341. The machine described in this document only allows a single process to be performed on each container, particularly if it is desired to maintain a fast rate of operation of the machine. Indeed, the time a container spends on the machine is inversely proportional to the number of containers processed during a given time period, and in any event this time spent is less than the time required for the turntable to make one rotation. In addition, the usable time for processing is limited still more by the time required for loading, discharging, and the two turnovers of each container.

For example, when a container such as a bottle is to be decontaminated prior to being filled, it must undergo several successive processes. It may thus be necessary to proceed with a first rinse, spraying a cleaning and sterilization product into the container, then a second rinse. In this situation, the two rinse operations must, for example, be done with the neck of the container turned downward, while the spraying of the cleaning product should, for example, be done with the neck turned upward to allow the product to remain in contact with the walls of the container for a long enough time to act effectively.

The implementation of such processes with known equipment requires the use of several processing machines, each container passing from one machine to another. Such a system is not satisfactory from the point of view of the aggregate cost of the machines that must be used, and from the amount of space required by such a facility.

The machine described in the document EP-A-0.319.304 allows several consecutive processes to be performed on several containers, due to the presence of several stations and several devices for processing containers held by each station. However, this is a sequential machine, and it therefore operates at a relatively low speed and requires a relatively large amount of space compared to the relatively small number of containers that it can process simultaneously.

Another type of known processing machine is composed of heating ovens or temperature conditioning ovens for preforms or blanks of containers in facilities for manufacturing containers by blow-molding or drawing then blow-molding of previously heated preforms, such as the facilities of the type described in the French patent FR-2.479.077. In these machines, the preforms or blanks follow a loop circuit, being carried by rotary gripping systems, while the containers themselves are rotating, they pass through heating areas having heating elements and reflectors. In the facility described in this document, the preforms or blanks are introduced neck up, then are turned over to be reheated with their neck downward to prevent the neck from overheating and becoming deformed during their subsequent blow-molding operation, and are turned over a second time to allow the containers to be blow-molded with the neck up. As mentioned before, with this type of machine the time a preform spends on the machine is inversely proportional to the number of preforms processed during a given period of time, and the effective heating or conditioning time is limited by the time required for loading, discharging, and to the two turnovers of each preform. Other facilities are known where the containers are blow-molded neck down and where a second turnover does not take place.

A purpose of the invention is to propose a particularly compact and economical machine that is able to perform processing of objects at a high rate of speed.

To that end, the invention proposes a machine of the type described above, in which, between the points of loading and discharge the object is moved relative to the station by the gripping system, from an initial loading position to at least one processing position, then to a final discharge position, of the type in which the machine has devices for processing objects held by each station, of the type in which each station is furnished with a gripping unit composed of at least two gripping systems, and of the type in which the gripping unit is movable, with respect to the station, between at least a first position, for which a first object carried by a first system of the unit is in its initial position while a second object carried by a second system of the unit is in a processing position, and a last position for which the first object is in a processing position while the second object is in its final position, characterized in that, between the loading and discharge of an object, the path followed by the object comprises a number of turns of the circuit that is between the number of gripping systems of each processing unit and the next lower whole number.

The invention makes it possible to keep each object on one respective station during a routing time that is more than the station needs to make one complete turn of the circuit. It is therefore possible to have the same object move several times past the same point in the path, with the position of the gripping unit, and thus the spatial position of the object, having been modified.

Consequently, a machine according to the invention can be used to perform several successive processes without being any larger than a machine of the prior art that only allowed a single process, and of course, without reducing the speed. Thus, the processes of rinsing and cleaning objects can be done in the same space.

The invention can also be advantageously used to increase the duration of processing of an object, without reducing the overall speed of operation of the facility and without increasing the size.

As a result, for the same processing time it becomes possible to reduce the size of a machine that can only perform one type of process, while effecting, for each position of an object, one part of the process, which, for example, is the case for machines for heating preforms or blanks or containers in facilities for manufacturing containers by blow-molding, or drawing then blow-molding, of previously heated preforms: in effect, it is possible to perform one part of the heating with the preforms or blanks in a neck-up position, and another part in a neck-down position.

According to other characteristics of the invention:

each time the gripping unit passes in front of the loading point, it is able to pick up an object;

each gripping unit is movable in rotation with respect to the associated station around an axis that is tangent, at a given point, to the direction of travel of the station at that point;

each gripping unit is sequentially movable between at least as many discrete positions as each gripping unit has gripping systems;

the processing devices follow the path of the stations, and each device is movable with respect to the adjacent stations between a disengaged position and an active position in which it can cooperate with at least one of the objects carried by one of the gripping units;

each processing device has at least two processing means each of which is intended to cooperate with one object, the two objects being carried respectively by two adjacent stations;

the processing devices are mounted on the frame of the machine along the path of the stations, so that the objects undergo the corresponding process when they pass in front of the devices;

the stations are integral with a drive device, composed of a rotary turntable of the machine;

the stations are integral with a drive device, composed of a closed loop drive chain of the machine;

the processing devices are movable in rotation with respect to the drive device around an axis that is appreciably perpendicular to the principal plane of the drive device, that is, parallel to the axis of rotation of the turntable when the drive device is composed of such turntable;

the gripping units and the processing devices are arranged appreciably on the same path; each processing device is interposed between two adjacent gripping units, and in the active position each processing device cooperates with objects of the two adjacent units flanking it;

because the machine is intended for cleaning and rinsing containers, each of the processing devices has at least one nozzle for spraying a rinse fluid and one nozzle for spraying a cleaning agent;

the initial and final positions of each object with respect to the station carrying it are identical;

because the objects are hollow bodies, such as containers or preforms of containers, each gripping unit has two gripping systems each of which carries one hollow body essentially by its open end;

the objects are arranged in inverse directions along two parallel axes that are contained in a radial plane of the path and which are offset on either side of the axis of rotation of the unit;

the positions of the two containers along the direction of their axes are partially overlapped;

because the machine is intended for the cleaning and rinsing of containers, in the initial position and final position the containers are in the vertical position with the open end downward in order to undergo a first and last rinse treatment; and in the processing position, the containers are in the vertical position with the open end upward in order to undergo an intermediate cleaning treatment during which a cleaning agent is injected into the container.

Other characteristics and advantages of the invention will become apparent in the following detailed description and attached drawings, in which.

Figure 4:
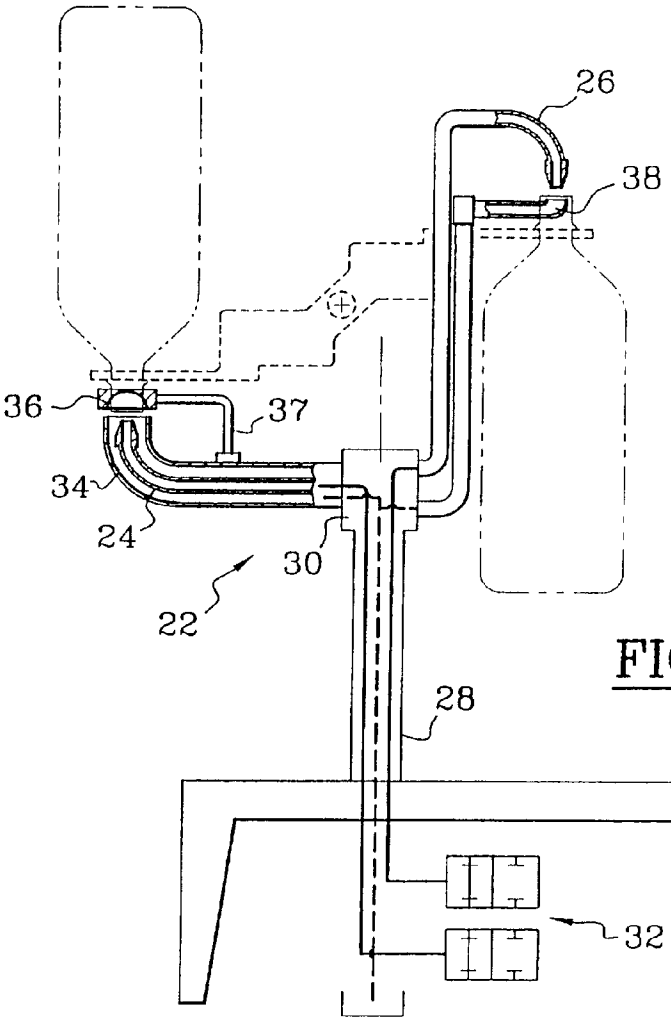
Figure 5:
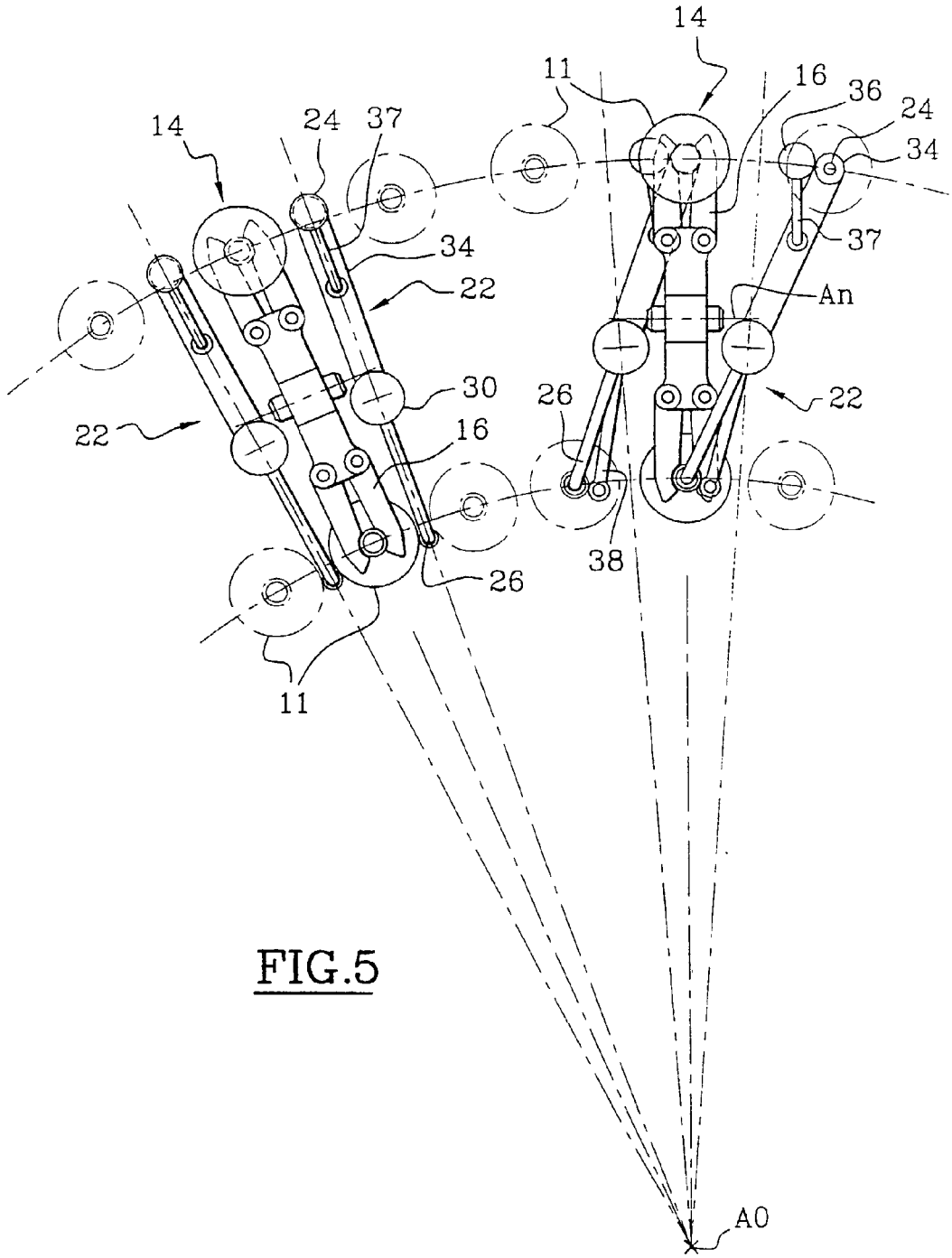
Figure 6:
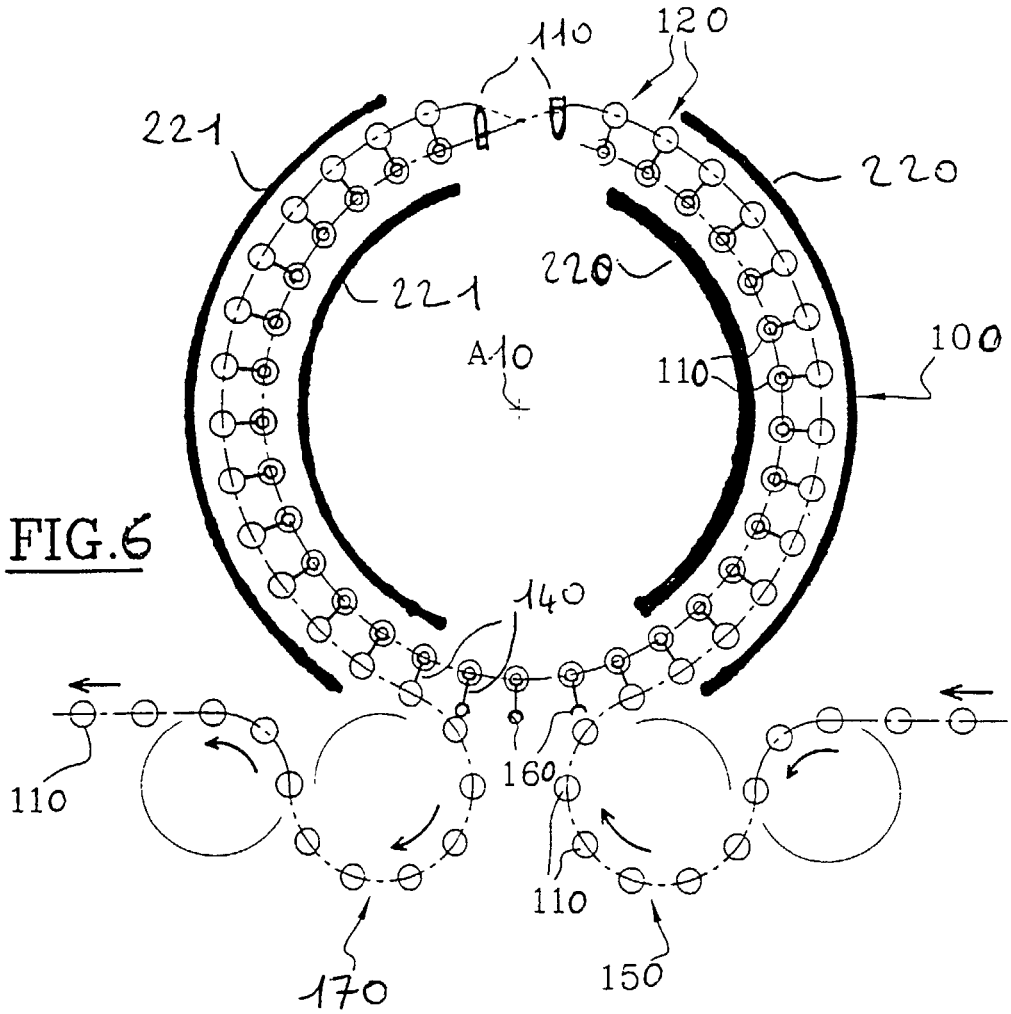

FIG. 4 diagrammatically illustrates a processing device that makes it possible simultaneously to process two containers;

FIG. 5 is a top view of the machine's turntable illustrating the two relative positions of the processing devices with respect to the gripping units;

FIG. 6 is a diagrammatic top view of a machine according to the invention, laid out for heating preforms or blanks of containers.

As will be set forth in greater detail, the invention can be applied, for example, quite advantageously to machines designed for rinsing and disinfecting containers, particularly bottles made of polyethylene terephtalate (PET), so that they can be filled with a liquid that can be food-grade, or machines for rinsing and disinfecting the blanks for said containers, called preforms.

The invention can also be applied very beneficially in machines for manufacturing containers by blow-molding said preforms, more specifically in the temperature conditioning ovens for said preforms situated upstream of the blow-molding devices.

The following description illustrates more particularly the processing of objects composed of hollow bodies, such as containers (bottles, flasks or others) or the preforms of containers.

Figure 1:
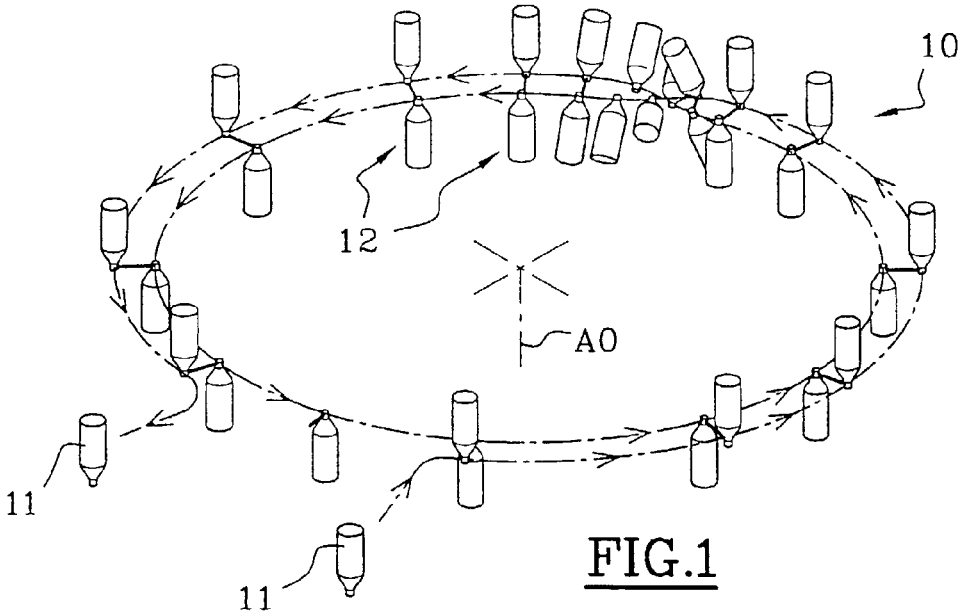
FIG. 1 is a diagrammatic view in perspective of the operating principle of a processing machine according to the invention.
Figure 2:
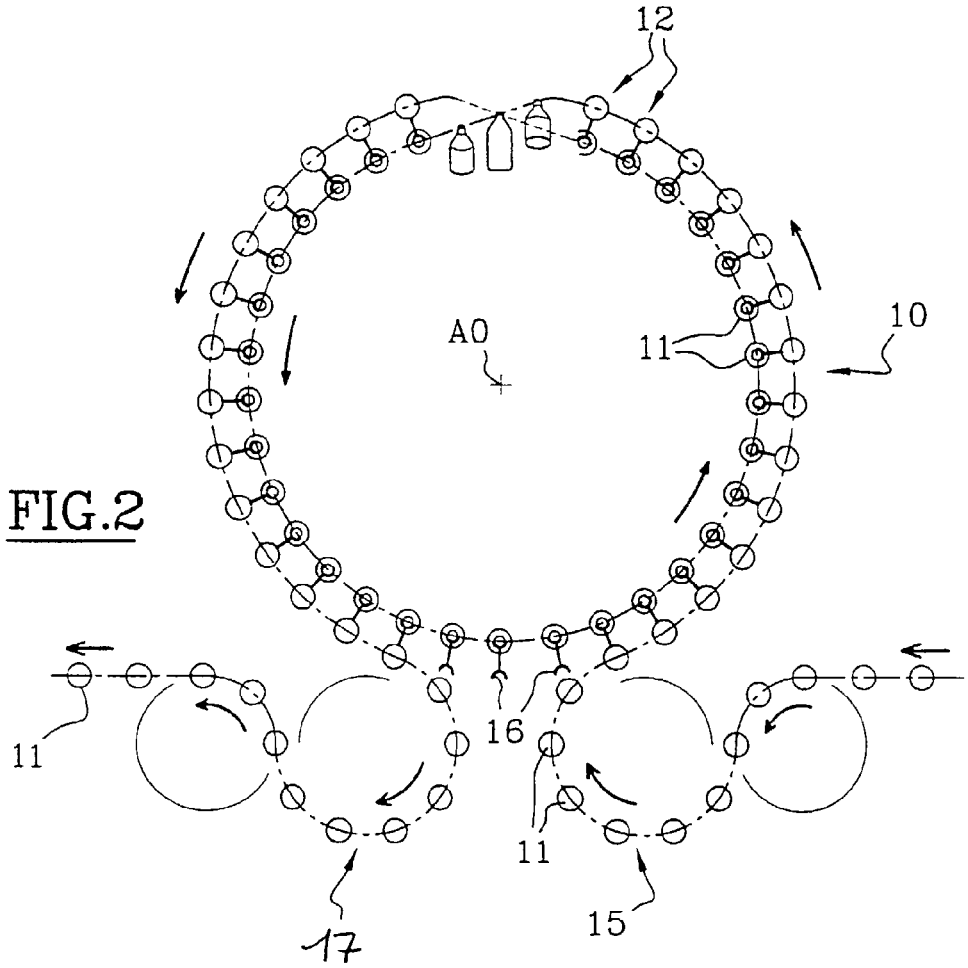
FIG. 2 is a diagrammatic top view of the machine according to the invention.

Illustrated in FIGS. 1 and 2 is the principle of a machine for processing objects, which is both compact and capable of high speeds. This machine has a series of stations 12 that make a looped path. In the illustrated example, all of the stations 12 are integral with a circular turntable 10 that is continuously driven in rotation around its axis A0. However, the invention could also be used within the scope of stations connected to each other according to the principle of an endless driven chain.

The principle of this machine is to keep each object on one respective station during a period of time that is more than the station needs to make one complete turn of its circuit. In this instance, the object remains on the station for nearly two turns.

The illustrated machine is therefore a rotary machine, the axis of rotation of which will be considered to be vertical for purposes of clarity of the description. The turntable 10 has a series of stations 12 that are distributed angularly around the axis A0 and each of which is intended to carry a plurality of bottles 11. In the illustrated example, each station 12 can carry two bottles. However, the invention can also be implemented with stations that are able to handle more bottles.

Each station has a bottle gripper unit 14 that is movable with respect to the station, and therefore with respect to the turntable, and which in this instance has two gripping systems 16 each of which can hold one bottle. In the example, this involves grippers that can grasp a PET bottle by the neck, these grippers preferably being grippers the opening and closing of which is controlled by a specific mechanism that can prevent any risk of accidental opening of the gripper when the bottle is being processed, the grippers also allowing the opening of the bottles to remain free in order to permit a rinse or cleaning agent to be introduced when the machine is designed for that function.

Each gripper unit 14 is mounted movably in rotation with respect to its station 12 around an axis An that is tangent to the path of the station. In this instance, each gripper unit is designed to be able to occupy two positions that are 180 degrees opposite to each other around the axis An. However, in the case of a gripper unit having more than two gripping systems, it will be provided for the unit to be able to occupy at least as many different discrete positions as the number of bottles the unit can carry. In all cases, the number of positions for one unit can be greater than the number of bottles.

The gripping systems 16 are arranged so that the bottles carried by one unit are disposed along two parallel vertical axes, symmetrically on either side of the axis An and the bottles being reversed with respect to each other. Thus, when one of the bottles is oriented with its open end upward, the open end of the other bottle is oriented downward.

Figure 3:
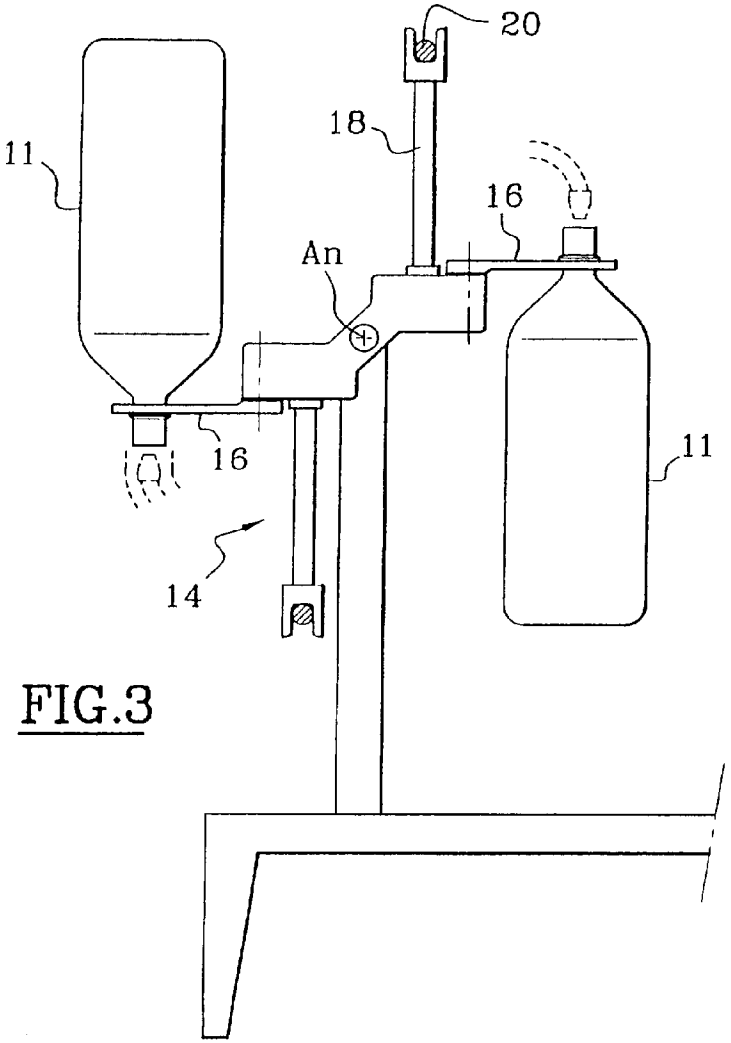
FIG. 3 illustrates a unit for gripping the containers.

As can be seen in FIG. 3, the grippers 16 are offset in the direction of the axes of the bottles and are placed on either side of the axis An so that the gripper that carries the bottle neck downward is situated below the level of the gripper that carries the bottle neck upward. This arrangement decreases the amount of free space required for the turnover of the gripping unit when it is carrying the bottles.

Clearly, the gripping unit 14 is completely symmetrical with respect to the axis An. Because of the geometry of the gripping unit 14, each gripper is alternately taken to an outer radial position and an inner radial position with respect to the axis A0 of the turntable. In one case, the bottle that the gripper carries is oriented neck downward, in this instance when the gripper is in the outer radial position. In the inner radial position, it is oriented neck upward. Regardless of the position of the gripping unit 14, the axes of the bottles are all appreciably in the same radial plane containing the axis A0 of rotation of the turntable and perpendicular to the axis An of rotation of the unit 14 in question.

In FIGS. 1 and 2 it can be seen that appropriate conveyor systems 15, of a known type, take the containers 11 to a loading point tangential to the turntable, the position of which is fixed around the axis A0. At this point, in this particular case of a rinsing and cleaning machine, the bottle is picked up, neck downward, by the external gripper of a gripping unit. As the turntable rotates, each time a station passes the loading point it picks up a container by grasping it with the gripper which, at that moment is in the outer radial position. Once it has been picked up by the gripping unit 14, the bottle is then driven in rotation around the axis A0 by the turntable, nearly one half a turn, until it reaches the turnover sector.

At the turnover sector, the gripping unit 14 is driven in rotation 180 degrees around its axis An. In this way, the bottle that was initially in the outer radial position with the neck downward is moved to the inner radial position with the neck upward.

Various means can be used to control this turnover of the gripping unit 16. In the example illustrated in FIG. 3, it can be seen that each gripping unit 16 has two arms 18 that extend symmetrically in a plane perpendicular to the axis An. Each arm 18 has a U-shaped end which, during the rotation of the turntable, is intended to follow a rail 20 attached to the machine.

Along the angular sectors for which the gripping unit 16 remains fixed, the rails are arranged along arcs of circles with the axis A0. At the turnover sector, each rail 20 extends along a section of a coiled helix on a toroidal surface. Such a means of controlling the turnover is similar to the one described in the document EP-A-0.477.341 and it will be noted that, thus controlled, the processing unit 14 always turns in the same direction around its axis An. However, other means may be used, such as motorized actuators.

In the example illustrated, each gripping unit 14 is only designed to occupy two positions and only one turnover sector is provided. In this way, a bottle that has been loaded onto the turntable and has just been turned over is caused to make one complete turn in the inner radial position. Within the scope of a cleaning and disinfecting process, this gives the sterilizing agent sufficient time to act. However, a machine could be contemplated that has three turnover sectors, for example. Also, the gripping unit could be placed in a certain number of intermediate positions.

Of course, it could also be provided for the bottles to be picked up with the neck up and turned over in order to place them on the machine with the neck down.

At the end of its turn in the inner radial position, the bottle is again placed in the outer radial position by the gripping unit. It has then made about one and one half turns around the axis A0 since it was loaded on the turntable.

As the rotation of the turntable continues, the bottle in question in the outer radial position arrives at a discharge point which, in the direction of rotation, is situated just before the loading point. At the discharge point, a conveyor system 17 removes the bottles, thus successively freeing the stations which, arriving at the loading point, can again pick up a bottle to be processed.

In the example described, the gripping unit only occupies two distinct discrete positions. Also, the initial loading and final discharge positions for a bottle are the same. However, it could be contemplated that these two positions of the bottle could be different.

As a result of this design of the machine, it is possible to provide complete cleaning and disinfecting of a bottle between the loading and discharge, without having to transfer the bottle between two processing stages. Thus, without the bottle being released, it can successively undergo a first rinse, a disinfecting by spraying a sterilizing agent, and a final rinse to eliminate the traces of the sterilizing agent.

It will be easily understood that the relative duration of the various processing stages also depends on the placement of the turnover sector or sectors with respect to the circuit. Thus, departing from the example illustrated in FIGS. 1 and 2, it would be possible to reduce the duration of the first rinse by placing the turnover sector closer to the loading point of the bottles. Correlatively, the duration of the final rinse would be increased. Ultimately, it could be possible to perform only two processing steps by placing the turnover sector in the immediate proximity of the loading point or the discharge point.

The invention therefore offers great flexibility.

In the example described above, each gripping unit 14 has only two gripper systems 16 so each container makes a number of turns of the turntable that is a fraction between 1 and 2. For a machine having four gripper systems per gripping unit, each container would make between 2 and 3 turns on the turntable.

The machine according to the invention also has processing devices 22 that are suitable for spraying liquids inside the bottle, such as water or a sterilizing agent. The spraying of a gas or any other agent could also possibly be considered.

As can be seen in FIGS. 4 and 5, each device has two spray nozzles: one external nozzle 24 that can spray a rinse agent—a liquid in this instance—upward into a bottle placed with its neck downward in the outer radial position, and an internal nozzle 26 that can spray the sterilizing agent downward inside a bottle arranged neck up in the inner radial position.

In FIG. 5 it can be seen that each device 22 is movable between a disengaged position and an active position. Indeed, each device 22 is fitted at the top of a vertical column 28 which, with respect to the axis A0, is situated radially between the outer circle and the inner circle of the path of the bottles. At the top of the column 28, the two nozzles 24, 26 are mounted in rotation around the axis of the column 28, preferably by means of a rotary connector 30 that allows the nozzles 24, 26 to be connected to the machine's product distribution systems 32. The two nozzles 24, 26 extend opposite to each other with respect to the column 28.

There are the same number of processing devices 22 as there are gripping units 14 and said devices are angularly interspersed between the stations 12. In the disengaged position, the two nozzles 24, 26 are oriented appreciably in a radial plane containing the axis A0 so as not to interfere with the adjacent gripping units 14, nor with the bottles being carried by them. In this position, they do not impede the turnover of the bottles. In the active position, the two nozzles are pivoted around the vertical axis of the column 28, so that the internal nozzle 26 faces the opening of a bottle in the inner radial position on one of the two stations adjacent to the device 22. The external nozzle 24 is then facing the opening of a bottle in the outer radial position on the other of the two adjacent stations.

In the active position, a device 22 can therefore process two bottles at the same time by spraying the rinse liquid into one and a sterilizing agent into the other. For the proper operation of the machine, however, the device should be returned to the disengaged position at the angular turnover sector, as well as at the angular sector along which the bottles are loaded and discharged.

As can be seen in FIG. 4, the external nozzle 24, which sprays rinse liquid into a bottle disposed neck downward, is coaxially received into a tubular recovery line 34 the open end of which faces the neck of the bottle when the devices is in the active position. The recovery line 34 can thus collect the rinse liquid that drains from the bottle and evacuate it, via the rotary connector 30, to the machine's distribution systems. Of course, the internal nozzle 24 and the recovery line 34 are integral with each other.

Moreover, the devices 22 have means to prevent the product from being sprayed on the machine if there is no bottle on one of the stations. In effect, the external nozzle 24 has a movable deflector which, when there is no bottle, is located just in front of the nozzle 24 and of the recovery line 34. Thus, the liquid sprayed by the nozzle 24 is sent directly to the recovery line.

The deflector 36 is placed at the end of an arm 37 that can pivot with respect to the nozzle 24 and the line 34 around a vertical axis parallel to the axis of pivoting of said nozzle and line. When the nozzle 24 changes over from its disengaged position to its active position, the deflector 36 is designed to press against the neck of the bottle, if there is one. In this case, the deflector 36 pivots with respect to the nozzle 24, which continues its course to its active position facing the open end of the bottle. Thus, when a bottle is present, the deflector is moved away from the nozzle and does not disturb the spraying of liquid.

However, in the absence of a bottle, the deflector 36 does not meet a support surface and remains facing the nozzle 24, which is its normal position to which it is returned by elastic means (not represented).

In a similar way, the internal nozzle is equipped with a recovery tube 38 which, in the absence of a bottle, is situated just in front of the nozzle 26. When a bottle is present, the tube 38 is pivoted away from the neck of the bottle when the device 22 changes over from its disengaged position to its active position.

These two anti-spray devices are entirely mechanical and are therefore particularly simple to implement. However, it is also possible to replace them with improved devices having means of detecting the presence of a bottle and valve means to control the spraying of liquid based on information furnished by the detection means.

In the machine illustrated in FIGS. 1 to 5, advantage is taken of the initial and final positions of the container, which are identical, to process said container, in this instance through rinsing operations. The duration of these operations is sufficient due to the fact that the container remains in these two positions during nearly one half of one turns of the turntable.

The machine thus proposed is therefore particularly simple and compact, while still permitting the implementation of a complete cleaning and sterilization process of the container.

As was mentioned above, the invention has another particularly advantageous application in heating preforms or blanks of containers in facilities for manufacturing plastic containers by blow-molding, or drawing then blow-molding, said preforms or blanks.

FIG. 6 is a diagrammatical illustration thereof.

As in FIGS. 1 and 2, the machine has a series of stations 120 that follow a loop path. In the illustrated example, all of the stations 120 are integral with a circular roundtable 100 that is continuously driven in rotation around its vertical axis A10. However, the invention could also be implemented with stations connected to each other according to the principle of chain links.

The stations 120 are angularly distributed around the axis A10 and each of them is intended to carry a plurality—two in the illustrated example—of preforms 110 or blanks for containers.

Each station has a gripping unit 140 for the preforms 110 or blanks of containers that is movable with respect to the station, and therefore with respect to the turntable, and which in this instance has two gripping systems 160 each of which can pick up a container preform 110 or blank. Each gripping system 160 has means, not illustrated in detail but known per se, for grasping a preform 110 or blank of a container, as well as means to allow the rotation of the preforms 110 around their longitudinal axis at least when the preforms are in a heating zone.

Thus, the means for grasping are composed for example of mandrel type mechanisms that grasp the interior or exterior of the neck of the preforms, and the means for placing the preforms in rotation around their own axes are mechanically connected to the grasping means. The rotation is accomplished for example by sprocket chains, known per se and not represented.

Just as with the applications intended for rinsing and cleaning containers, illustrated in FIGS. 1 to 5, each gripping unit 140 is movably mounted in rotation with respect to its station 120 around an axis that is tangential to the path of the station. In the example, each gripping unit can occupy two positions that are 180 degrees opposite around this axis.

The gripping unit 140 is symmetrical with respect to the axis tangential to the path of the station. Because of the geometry of the gripping unit 140, each preform is alternately moved to the neck-down position and the neck-up position.

Appropriate conveyor systems 150, of a known type, take the container preforms 110 or blanks tangentially to a loading point on the turntable, the position of which is fixed around the axis A10. At this point, each preform is picked up by the grasping means of a gripping unit. As the turntable rotates, each time a station passes the loading point it picks up a preform 110. Once it has been picked up by the gripping unit 140, each preform 110 is then driven in rotation around the axis A10 by the turntable, nearly one half a turn in the illustrated example, until it reaches the turnover sector.

At the turnover sector, the gripping unit 140 is driven in rotation 180 degrees around its axis tangential to the path of the station. In this way, the preform that was initially in a position with the neck upward is moved to the inner radial position with the neck downward.

Means that are similar or identical to those described with respect to FIGS. 1 to 5, such as rails, can be used to ensure the turnover, always in the same direction, as well as holding the gripping units in a fixed position. They will therefore not be described in more detail.

In the example illustrated, each gripping unit 140 can only occupy two positions and only one turnover sector is provided.

At the end of its turn in the neck-down position, the preform is returned to the neck-up position by the gripping unit. It has then made approximately one and one half turns around the axis A10 since it was loaded onto the turntable.

As the rotation of the turntable continues, the preform in the neck-up position reaches a discharge point where a conveyor system 170 removes each preform and takes it to a blow-mold, not represented, thus successively freeing the stations which, when arriving at the loading point, can again pick up a preform to be heated.

In the example described, since the gripping unit only occupies two distinct discrete positions, the initial loading and final discharge positions of a preform are the same. However, it could be foreseen that these two positions of the preform could be different, particularly in facilities in which the preforms are introduced with the neck upward, and the blow-molding of the containers is performed with the neck downward.

In this application, the processing consists of heating preforms 110, and processing devices 220, 221, composed of means for heating the preforms 110, the structure of which is known per se, are attached to the frame of the machine and are appropriately arranged in the areas between the loading area 150 and the turnover area on the one hand, as well as between the turnover area and the discharge area on the other, so as to heat the preforms that pass in front of these means, whether they are in the neck up or neck down position. By way of example, these heating means are composed of lamps and reflectors.

As a result of this design of the machine, and with the example illustrated where the stations can take two positions, the heating is performed in two turns of the turntable, and it is easy to understand that it is possible to reduce the circumference of the turntable by approximately half to achieve the same results, in terms of speed and efficiency, as a conventional machine. It therefore succeeds in considerably reducing the space required for a container manufacturing facility.

It is easily understood that the relative duration of the various heating stages depends on the placement of the turnover sector or sectors with respect to the circuit. In the example, after the preforms are loaded they go nearly half way around the circuit where they are heated with the neck up, then go one turn with the neck down, and finally go nearly a half turn again with the neck up. However, it would be possible to reduce the duration of the first neck-up heating by placing the turnover sector closer to the point of loading of the preforms; alternatively, it would be possible to reduce the duration of the second neck-up heating by placing the turnover sector closer to the point of discharge of the preforms.

Ultimately, it could be possible to perform only two heating stages by placing the turnover sector in the immediate proximity of the loading point or the discharge point. In this case, depending on the option selected, the heating would begin with the neck down or neck up; moreover, in this case there would no longer be heating means in the area between the point of loading and the turnover sector or in the area between the turnover sector and the point of discharge.

The invention is therefore particularly advantageous in this particular type of application because it makes it possible to reduce the floor space required by the heating ovens. Moreover, it allows the heating to be optimized due to the possibilities of positioning the preforms with the neck up or neck down.

What is claimed is:

1. A machine for processing objects (11; 110), in particular hollow bodies including containers or preforms of containers, the machine comprising:

a series of stations (12; 120) that are movable along a path in a loop circuit, each station having a gripping system (16; 160) intended to pick up an object (11; 110) at a point of loading and to return the object at a point of discharge of the path, wherein, between the points of loading and discharge, the object (11; 110) is moved relative to the station (12; 120) by the gripping system (16; 160), from an initial loading position to at least one processing position, then to a final discharge position, the machine having devices (22; 220; 221) for processing objects held by each station, each station is furnished with a gripping unit (14; 140) composed of at least two gripping systems (16; 160), wherein the gripping unit (14; 140) is movable, with respect to the station, between at least a first position, for which a first object carried by a first system (16; 160) of the unit (14; 140) is in an initial position while a second object carried by a second system (16; 160) of the unit (14; 140) is in a processing position, and a last position for which the first object is in a processing position while the second object is in a final position, wherein, between the loading and discharge of an object, the path followed by the object comprises a number of turns of the circuit that is between the number of gripping systems (16; 160) of each processing unit (14; 140) and the next lower whole number.

2. The processing machine according to claim 1, wherein each time the gripping unit (14; 140) passes in front of the loading point, gripping unit is able to pick up an object.

3. The processing machine according to claim 1, wherein each gripping unit (14; 140) is movable in rotation with respect to the associated station (12; 120) around an axis (An) that is tangent, at a given point, to the direction of travel of the station (12; 120) at that given point.

4. The processing machine according to claim 1, wherein each gripping unit (14; 140) is sequentially movable between at least as many discrete positions as each gripping unit (14; 140) has gripping systems (16; 160).

5. The processing machine according to claim 1, wherein the initial and final positions of each object (11; 110), with respect to the station carrying the object, are identical.

6. The processing machine according to claim 5, wherein the processing devices (22) are movable in rotation with respect to a turntable (10; 100) around an axis that is appreciably parallel to the axis of rotation (A0) of the turntable.

7. The processing machine according to claim 6, wherein the gripping units (14) and the processing devices (22) are arranged appreciably on the same circle around the axis of rotation (A0) of the turntable, and each processing device (22) is interposed between two adjacent gripping units (14), and, in the active position, each processing device (22) cooperates with objects of the two adjacent units flanking the respective processing device.

8. The processing machine according to claim 1, wherein the stations (12; 120) are integral with a drive device, composed of a rotary turntable (10; 100) of the machine.

9. The processing machine according to claim 8, wherein the processing machine is intended for processing containers (11), and each gripping unit (14) has two gripping systems (16) each of which carries one hollow body essentially by an open end of the hollow body, and in that the objects are arranged in inverse directions along two parallel axes that are contained in a radial plane of the path and which are offset on either side of the axis of rotation (An) of the unit (14), and the positions of the two containers along the direction of the axes are partially overlapped.

10. The processing machine according to claim 9, wherein in the initial position and final position, the containers are in the vertical position with the open end downward in order to undergo a first and last rinse treatment.

11. The processing machine according to claim 9, wherein in the processing position, the containers are in the vertical position with the open end upward in order to undergo an intermediate cleaning treatment during which a cleaning agent is injected into the container.

12. The processing machine according to claim 8, wherein the processing devices (22) are movable in rotation with respect to the endless chain around an axis that is appreciably perpendicular to the principal plane of the endless chain.

13. The processing machine according to claim 12, wherein the gripping units (14) and the processing units (22) are arranged alternately on the endless chain so that each processing device (22) is interposed between two adjacent gripping units (14), and, in the active position, each processing device (22) cooperates with the objects of the two adjacent units flanking the respective processing device.

14. The processing machine according to claim 1, wherein the stations (12; 120) are integral with a drive device, composed of a closed loop drive chain.

15. The processing machine according to claim 1, wherein the processing devices (22) follow the path of the stations (12), and each device (22) is movable with respect to the adjacent stations (12) between a disengaged position and an active position in which the device can cooperate with at least one of the objects carried by one of the gripping units (14).

16. The processing machine according to claim 15, wherein each processing device (22) has at least two processing means (24, 26) each of which is intended to cooperate with one object, the two objects being carried respectively by two adjacent stations (12).

17. The processing machine according to claim 16, wherein the processing machine is intended for processing containers (11), and each of the processing devices (22) has at least one nozzle (24) for spraying a rinse fluid and one nozzle (26) for spraying a cleaning agent toward the containers.

18. The processing machine according to claim 1, wherein the processing devices (220; 221) are mounted on a frame of the machine and are placed facing the areas traversed by the objects during routing.

19. The processing machine according to claim 18, further comprising an area for loading objects and an area for discharging objects, at least one area for changing the position of the gripping units (140) between the loading and discharge areas, and wherein the processing devices (220; 221) are placed between the area for loading the objects and an area for changing the position of the gripping units (140) and/or between an area for changing the position of the gripping units (140) and the discharge area.

20. The processing machine according to claim 19, further comprising at least two areas for changing the position of the gripping units (140) between the loading and discharge areas and the processing devices (220; 221) are interspersed between at least two successive areas for changing the position of the gripping units (140).

21. The processing machine according to claim 18, wherein the processing machine is intended for heating container preforms (110), and the processing devices (220; 221) are composed of means of heating said preforms.

* * * * *